US008257238B2

(12) United States Patent
Eijkelkamp

(10) Patent No.: US 8,257,238 B2
(45) Date of Patent: Sep. 4, 2012

(54) METHOD AND APPARATUS FOR FEEDING AND FOLDING SHEETS

(75) Inventor: Marcus Franciscus Eijkelkamp, Groningen (NL)

(73) Assignee: Neopost Technologies, Bagneux (FR)

( * ) Notice: Subject to any disclaimer, the term of this patent is extended or adjusted under 35 U.S.C. 154(b) by 402 days.

(21) Appl. No.: 12/693,989

(22) Filed: Jan. 26, 2010

(65) Prior Publication Data

US 2010/0190629 A1 Jul. 29, 2010

(30) Foreign Application Priority Data

Jan. 26, 2009 (EP) ..... 09151340

(51) Int. Cl.
*B31B 1/56* (2006.01)

(52) U.S. Cl. ..... 493/445; 493/434; 493/442

(58) Field of Classification Search ..... 493/424–426, 493/434, 435, 442–445, 454
See application file for complete search history.

(56) References Cited

U.S. PATENT DOCUMENTS

| | | | | |
|---|---|---|---|---|
| 2,000,636 | A | 5/1935 | Flynt | |
| 2,493,410 | A | 1/1950 | La Cour | |
| 3,057,621 | A | 10/1962 | Klaus | |
| 3,901,501 | A | 8/1975 | Kistner | |
| 4,419,088 | A | 12/1983 | Nemec | |
| 4,985,013 | A * | 1/1991 | van der Werff et al. | 493/444 |
| 5,707,330 | A | 1/1998 | Kiamco et al. | |
| 6,074,332 | A * | 6/2000 | Helmstadter et al. | 493/254 |
| 6,602,176 | B1 | 8/2003 | Ganneval | |
| 6,635,005 | B1 * | 10/2003 | Duhamel et al. | 493/417 |
| 6,939,283 | B2 * | 9/2005 | Sparano et al. | 493/424 |
| 7,121,993 | B2 | 10/2006 | Matsumoto | |
| 2008/0001338 | A1 | 1/2008 | Kotani | |

FOREIGN PATENT DOCUMENTS

| | | | |
|---|---|---|---|
| DE | 10 73 439 | B | 10/1960 |
| DE | 101 875 | A1 | 11/1973 |
| EP | 0 312 177 | B1 | 8/1992 |
| EP | 0 421 547 | B1 | 6/1995 |
| EP | 1 277 687 | A2 | 1/2003 |
| EP | 1 382 556 | B1 | 4/2008 |
| JP | 51-8025 | A1 | 1/1976 |
| JP | 60-209466 | A | 10/1985 |

* cited by examiner

*Primary Examiner* — Hemant M Desai
(74) *Attorney, Agent, or Firm* — Sughrue Mion, PLLC

(57) ABSTRACT

A method and apparatus are provided for feeding and folding sheets. Providing a folding blade having a free edge, reciprocably movable between a retracted position and a folding position, provided with blade surfaces adjacent to the free edge converging towards the free edge at a first angle in the folding position, and by further providing a pressing mechanism having pressing surface areas reciprocably movable between a retracted position and a pressing position, and enclosing in the pressing position a second angle larger than the first angle of the folding blade, allows an apparatus, having a pair of folding rollers and a sheet support, selectively to fold only an outer sheet from a set of sheets or to fold a set of sheets simultaneously.

8 Claims, 5 Drawing Sheets

METHOD AND APPARATUS FOR FEEDING AND FOLDING SHEETS

FIELD AND BACKGROUND OF THE INVENTION

The invention relates to an apparatus for feeding and folding sheet-like objects or a set of sheet-like objects, such as sheets of paper, envelopes, etc.

In small desktop systems for processing mail items compact size is an issue. To reduce size, in many apparatuses various functions, which in large apparatuses are implemented with different structures as rollers or conveyors, are combined in single structure. For instance, the functions of feeding a sheet from a stack and folding the sheet may be combined in one pair of feeding-folding rollers. In such systems, a sheet is positioned near the nip and buckled, e.g. by a wedge, and subsequently the buckled portion is plead and entrained by the folding rollers. By passing the plead portion through the nip, a fold is made in the sheet. In this way the functions of separating a sheet from a stack and folding the sheet are combined. Such apparatuses are known from European patent application 0 312 177, European patent application 0 421 547, U.S. Pat. No. 2,000,636, U.S. Pat. No. 2,493,410 and U.S. Pat. No. 3,057,621.

It is also known to feed and fold a set of stacked sheets using a pair of folding rollers using the wedge to plea and push all the stacked sheets into the nip, so that all the sheets in the stack are folded together. Apparatuses operating in this manner are known from U.S. patent application 2008/0001338 and U.S. Pat. No. 7,121,993.

For folding thick gate folded-paper, such as greeting cards, from European Patent application 1 277 687 a device is known applying a knife that entrains a pair of deflectors having a curved working face for engaging front side portions of the gate folded-paper to be processed. As the stroke of the knife towards a pair of folding rollers is larger than the stroke of the deflectors, which are immobilized at the end of the stroke by notches, the gated folded-paper is pushed trough the nip formed by the pair of folding rollers and subsequently folded.

As described above, the principle of combining feeding and folding rollers is known, however, it is not suitable for folding a set of stacked sheets, as in the case of daily mail (manually gathered sets of stacked sheets). The apparatuses suitable for folding several stacked sheets together can only fold a single sheet individually, when the sheets are fed separately, thus requiring additional means for separating the sheets in a stack prior to folding, such as rollers or conveyors, making the device more complex.

SUMMARY OF THE INVENTION

It is an object of the present invention to provide an apparatus that is suitable for selectively feeding and folding sheets of a stacked set of sheets together or feeding and folding sheets from a stacked set individually.

According to the invention, this object is achieved by providing an apparatus for feeding sheets from a sheet support and for folding the sheets fed from the feed support, having a pair of folding rollers defining a folding nip, a sheet support for supporting a stack of sheets the sheet support having a support surface facing the nip, a folding blade having a free edge, the folding blade being reciprocably movable relative to the folding rollers between a retracted position in which the free edge is spaced from the nip and a folding position in which the free edge is oriented towards the nip and closer to the nip than in the retracted position, for pressing a plied portion of the sheets between the free edge and the nip into the nip, blade surfaces adjacent to the free edge, at least when the blade is in the folding position, converging towards the free edge at a first angle, a pressing mechanism having pressing surface areas facing the folding rollers, the pressing surface areas being reciprocably movable relative to the folding rollers between a retracted position spaced from the folding rollers and a pressing position in which the pressing surface areas are closer to the folding rollers than in the retracted position, face the folding rollers, and enclose a second angle larger than the first angle, at least when in the pressing position, for pressing the stack of sheets against the folding rollers, and a drive for selectively moving either the folding blade into the folding position or the pressing surface areas into the pressing position. The invention can also be embodied in a method for selectively either folding only an outer sheet from a stack of sheets in a sheet support or simultaneously folding all sheets in a stack on a sheet support, the method including: providing a pair of folding rollers defining a folding nip in a position such that a sheet support surface of the sheet support faces the nip, providing a folding blade having a free edge spaced from the nip, blade surfaces adjacent to the free edge, at least when the blade is in the folding position, converging towards the free edge at a first angle providing a pressing mechanism having pressing surface areas spaced from the folding rollers, and rotating the folding rollers in a sense of transport, either moving the folding blade towards the nip into a folding position, thereby pressing a plied portion of the stack of sheets between the free edge and the nip into the nip and causing the stack of sheets to be folded and entrained by the rotating folding rollers, or at least moving the pressing surface areas towards the folding rollers into a pressing position, wherein, at least in the pressing position, the pressing surface areas enclose a second angle larger than the first angle, thereby pressing the stack of sheets against the folding rollers, such that only an outer sheet of the stack is engaged, plied into the folding nip, folded and entrained through the nip by the rotating folding rollers.

Providing a folding blade having a free edge, reciprocably movable between a retracted position and a folding position, provided with blade surfaces adjacent to the free edge converging towards the free edge at a first angle when at least in the folding position, and by further providing a pressing mechanism having pressing surface areas reciprocably movable between a retracted position and a pressing position, and enclosing, at least when in the pressing position, a second angle larger than the first angle of the folding blade, allows an apparatus, having a pair of folding rollers and a sheet support, selectively to fold only an outer sheet from a stacked set of sheets or to fold the sheets of a stacked set of sheets together into a folded stack of sheets.

Particular elaborations and embodiments of the invention are set forth in the dependent claims.

Further features, effects and details of the invention appear from the detailed description and the drawings.

DETAILED DESCRIPTION

Figure 1:
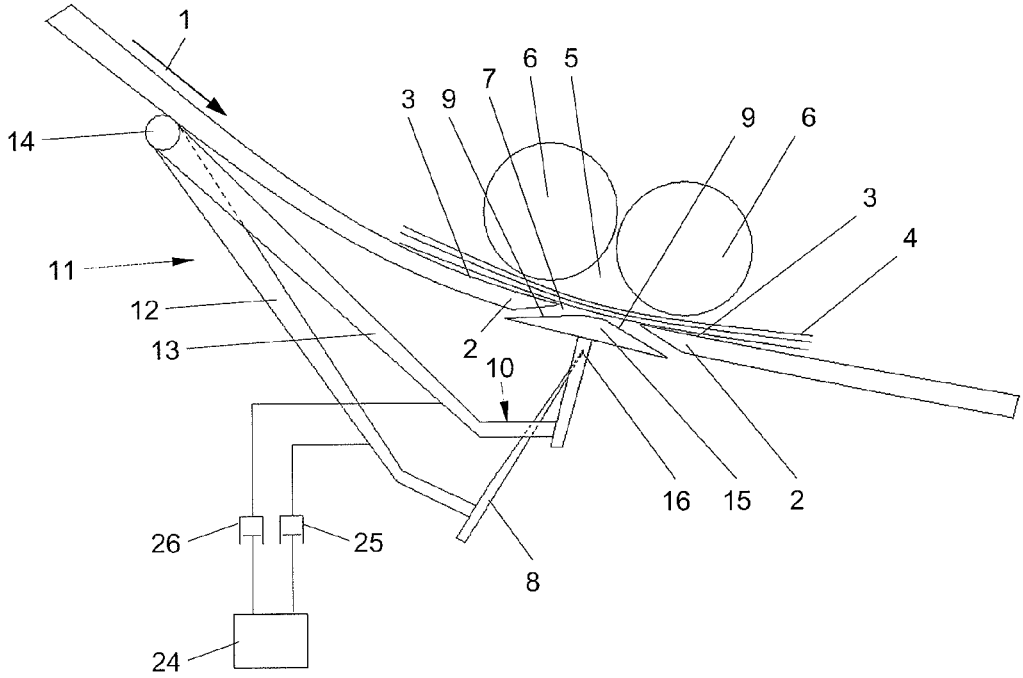
FIG. 1 is a schematic side view of an example of an apparatus according to the invention.

A small desktop mail processing apparatus, as shown in FIG. 1, has a guiding track 1 for guiding mail items along the guiding track towards a sheet support 2 having a support surface 3 that can support a stack of sheets 4. The support surface 3 faces a nip 5 defined by a pair of folding rollers 6 that are located above the sheet support 2. The support surface 3 is interrupted transverse to the transport direction and opposite of the nip 5, leaving an opening 7 for receiving a folding blade 8 or pressing surface areas 9 of a pressing mechanism 10. This opening 7 may stretch across the whole width of the support surface 3 or only a part thereof.

Below the sheet support a lever mechanism 11 is located, comprising an inner pair 12 and an outer pair of lever arms 13 pivoting around a pivot point 14. On the inner pair of lever arms 12 the folding blade 8 is mounted. The outer pair 13 carries a pressing member 15 of which the outer surface portions constitute the pressing surface areas 9 that face the folding rollers 6.

The folding blade 8 is movable to and fro relative to the folding rollers 6 between a retracted position, in which a free edge 16 is spaced from the nip 5, and a folding position, in which the free edge 16 is oriented towards the nip 5 and closer to the nip 5 than in the retracted position. The pressing member 15 is movable to and fro relative to the folding rollers 6 between a retracted position in which the pressing surfaces 9 are spaced from the folding rollers 6 and a pressing position in which the pressing surface areas 9 are closer to the folding rollers 6 than in the retracted position.

A drive 24 is provided for selectively moving either the folding blade 8 into the folding position or the pressing member 15 into the pressing position. In this example the drive 24 controls a piston 25 for movement of the pair of levers 12 and a piston 26 for movement of the pair of levers 13, but it can also be implemented with a system of curve disks, springs and/or electromagnetic actuators.

Figure 2:
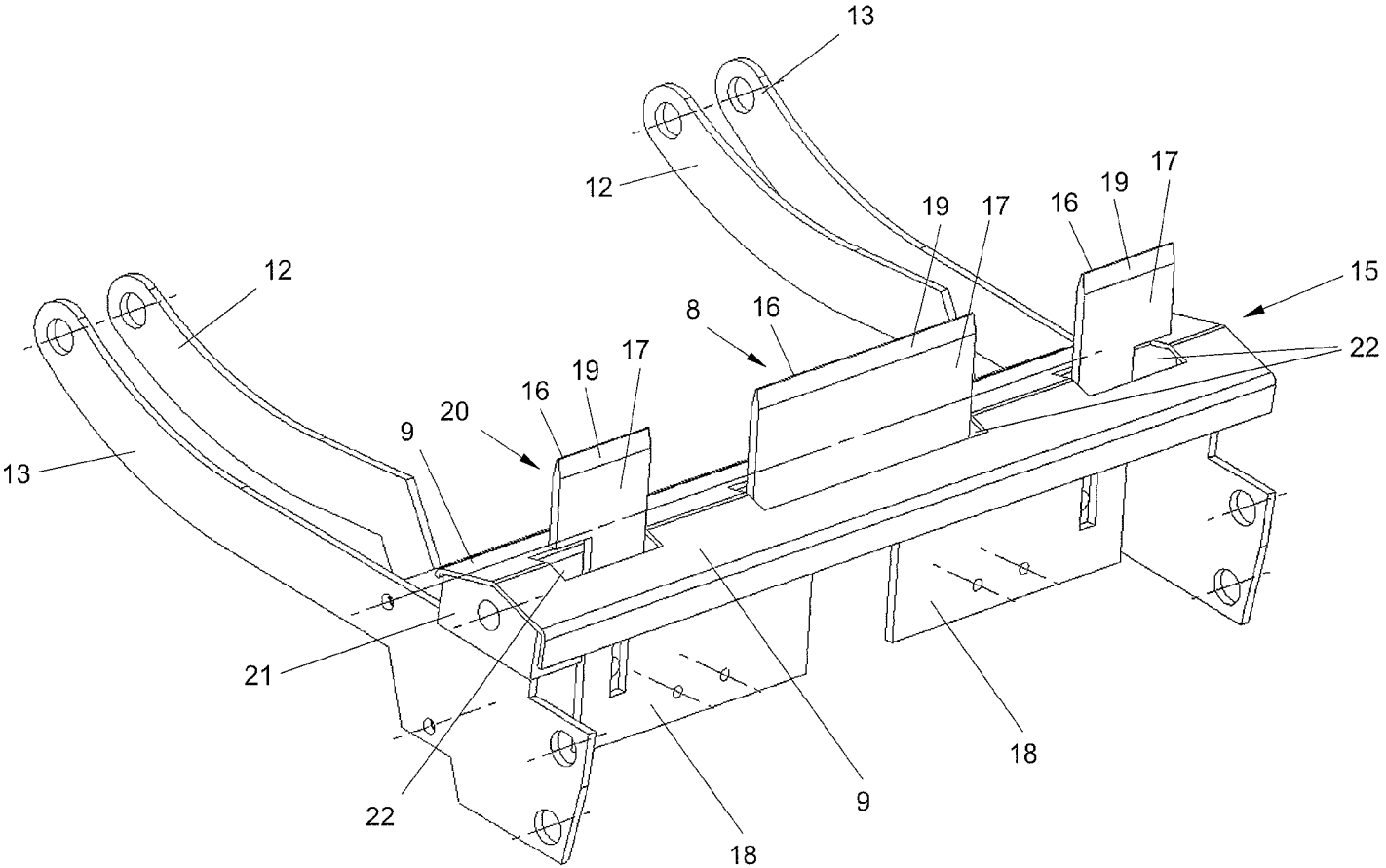
FIG. 2 is a perspective view of the pressing member and folding blade and suspension parts of FIG. 1.

In FIG. 2 the folding blade 8 and pressing member 15 are shown in more detail. The folding blade 8 is designed to work in close operation with the pressing member 15 and has folding portions 17 and recessed portions 18. The folding portions 17 have blade surfaces 19 converging at an angle 20 in the free edge 16. The pressing surface areas 9 of the pressing member 15 enclose a second angle 21 larger than the first angle 20 of the blade surfaces 19 of the folding blade 8. The pressing surfaces 9 are provided with openings 22 for accommodating the folding portions 17 of the folding blade 8. Thus, allowing the folding blade 8 in the folding position to project through the openings 22 of the pressing member 15.

When a stack of sheets 4 is guided to the support surface 3, only an outer sheet from the stack 4 can be folded or the stack 4 can be folded simultaneously as one set, as chosen by an operator.

Figure 3:
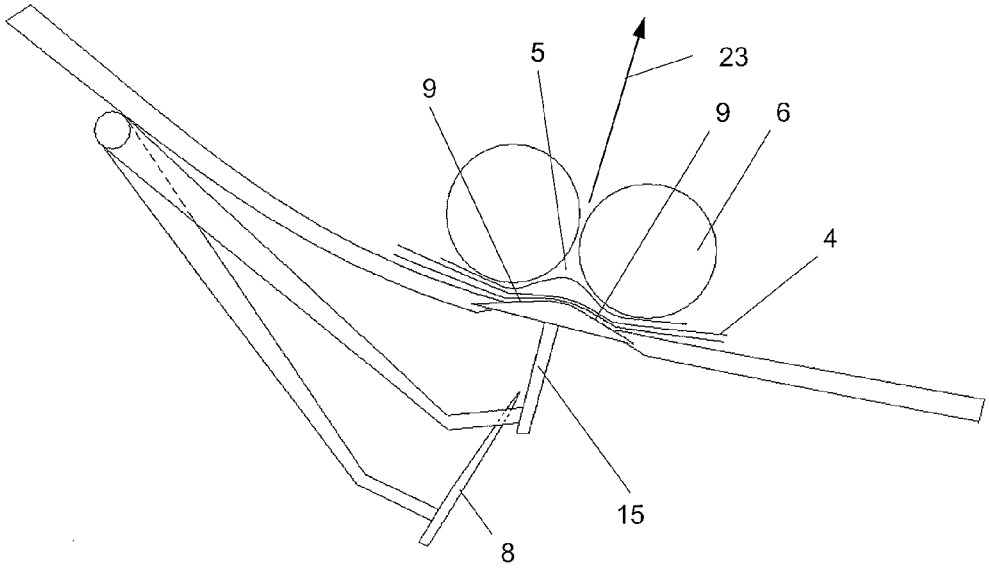
FIG. 3 is a schematic side view of the example of FIGS. 1 and 2 with the pressing member in a pressing position.

First, the folding of only one outer sheet will be illustrated by FIGS. 1 and 2. The pressing member 15 is effected by the drive to move from a rest position (FIG. 1) to an operating position (FIG. 3), while the folding blade 8 remains in the retracted position. Consequently, the pressing surface areas 9 are moved towards the folding rollers 6 into a pressing position, thereby buckling the stack of sheets 4 (FIG. 3). The folding rollers 6 rotating in a direction of transport 23 engage the outer sheet of the stack 4 and the sheet is plied into the folding nip 5. Subsequently, the entrained sheet is separated from the stack 4 and passes through the folding nip 5, resulting in a single folded sheet.

When the outer sheet of the stack 4 has been folded, the pressing member is moved closer to the nip 5 and a next sheet is entrained by the folding rollers 6 and folded. This continues until all sheets of the stack 4 are folded, after which the support surface is clear. Then the pressing member is moved to the resting position and a new stack can be processed.

Figure 4:
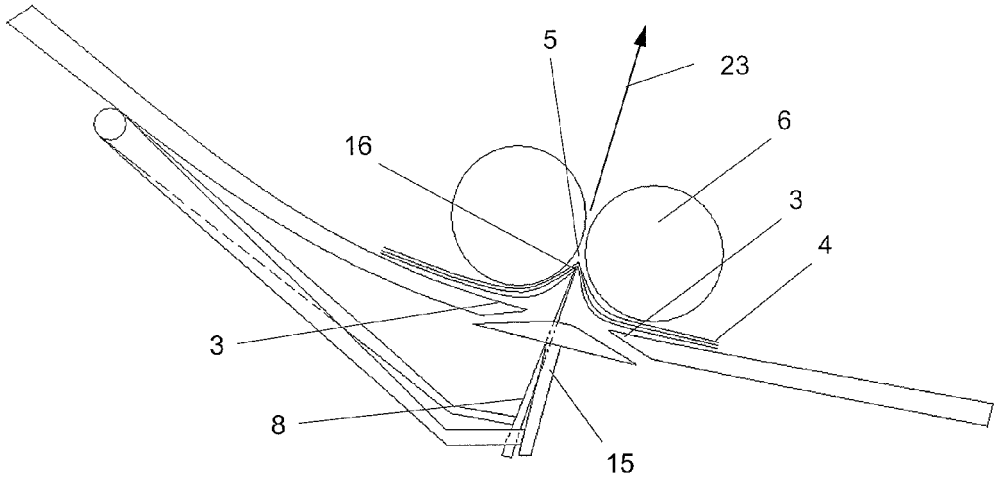
FIG. 4 is a schematic side view of the example of FIGS. 1-3 with the folding blade in a folding position.

Now, the folding of a set of sheets will be illustrated by FIGS. 1 and 4. When a stack 4 of sheets is present at the support surface 3 and the pressing member 15 is in the resting position, the folding blade 8 is moved by the drive from the retracted position (FIG. 1) towards the nip 5 into the folding position (FIG. 4). Thereby a plied portion of the stack of sheets 4 between the free edge 16 and the nip 5 is pressed into the nip 5. The folding rollers 6 rotating in a direction of transport 23 entrain the stack 4 and fold the stack 4 as one set.

When the stack 4 has been folded as one set, the folding blade 8 is moved to the retracted position, the support surface 3 is clear and a new stack can be processed.

By providing a folding blade 8 as well as a pressing member 15, a single pair of folding rollers 8 suffices to implement both modes of operation. In this manner the number of necessary components is limited and consecutively the size of the apparatus can be reduced.

Figure 5:
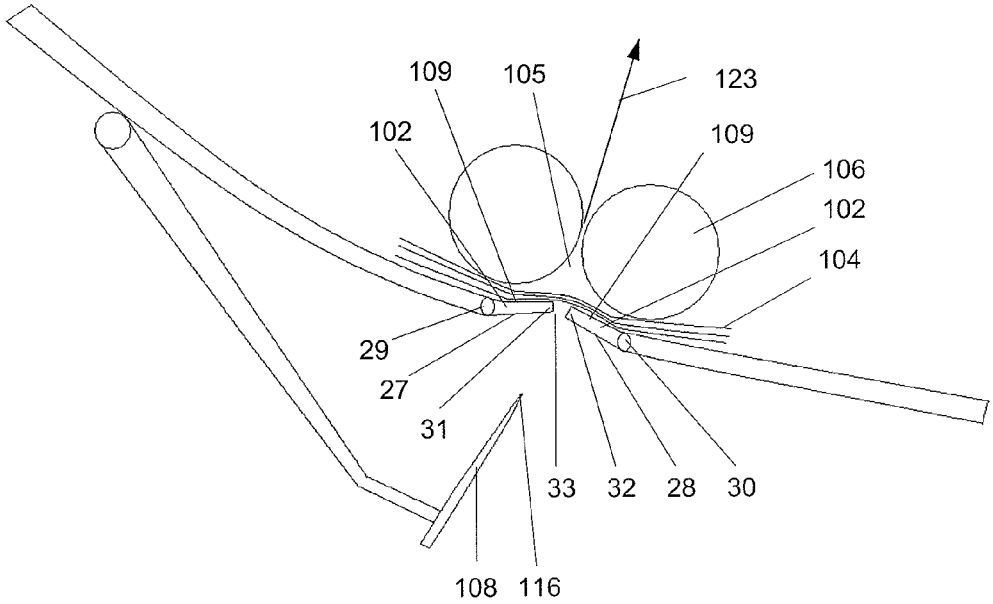
FIG. 5 is a schematic side view of a second example of an apparatus according to the invention.

In another embodiment according to the invention, shown in FIG. 5, the sheet support 102 is provided with flaps 27, 28 mounted with hinges 29, 30. The outer surfaces of the flaps 27, 28 constitute parts of the support surface 103. The flaps 27,28 are then reciprocally movable between a resting position, in which the flaps 27, 28 are spaced from the folding rollers 106, and a pressing position, in which tips 31, 32 of the laps 27, 28 are closer to the folding rollers 106 then in the resting position. In this manner areas of the sheet support 102 constitute pressing surface areas 109.

Furthermore, in the resting position, the tips 31, 32 of the flaps 27, 28 are spaced apart, defining a passage 33 to allow the folding blade 108 in the folding position to project through the passage 33 between the flaps 27, 28 and hence between the pressing surface areas 109.

In this embodiment folding a single sheet of the stack 104 is achieved by moving the flaps 27, 28 from the rest position to the pressing position, while the folding blade 108 remains in the retracted position. Consequently, the tips 29, 30 and hence the pressing surface areas 109 are moved towards the folding rollers 6, thereby buckling the stack of sheets 104. The folding rollers 106 rotating in a direction of transport 123 engage the outer sheet of the stack 104 and the sheet is plied into the folding nip 105. Subsequently, the entrained sheet is separated from the stack 104 and passes through the folding nip 105, resulting in a single folded sheet.

When the outer sheet of the stack 104 has been folded, the flaps 27, 28 are moved closer to the nip 105 and a next sheet is entrained by the folding rollers 106 and folded. This continues until all sheets of the stack 104 are folded, after which the support surface 103 is clear. Then the pressing member is moved to the resting position and a new stack can be processed.

Folding of the stack 104 as one set is done in a similar manner, as described above. When a stack 104 of sheets is present at the support surface 103 and the flaps 27, 28 are in the resting position, the folding blade 108 is moved by the drive from the retracted position towards the nip 105 into the folding position. Thereby a plied portion of the stack of sheets 104 between the free edge 116 and the nip 105 is pressed into the nip 105. The in the direction of transport 123 rotating folding rollers 106 entrain the stack 104 and fold the stack 104 as one set.

When the stack 104 has been folded as one set, the folding blade 108 is moved to the retracted position, the support surface 103 is clear and a new stack can be processed.

Figure 6:
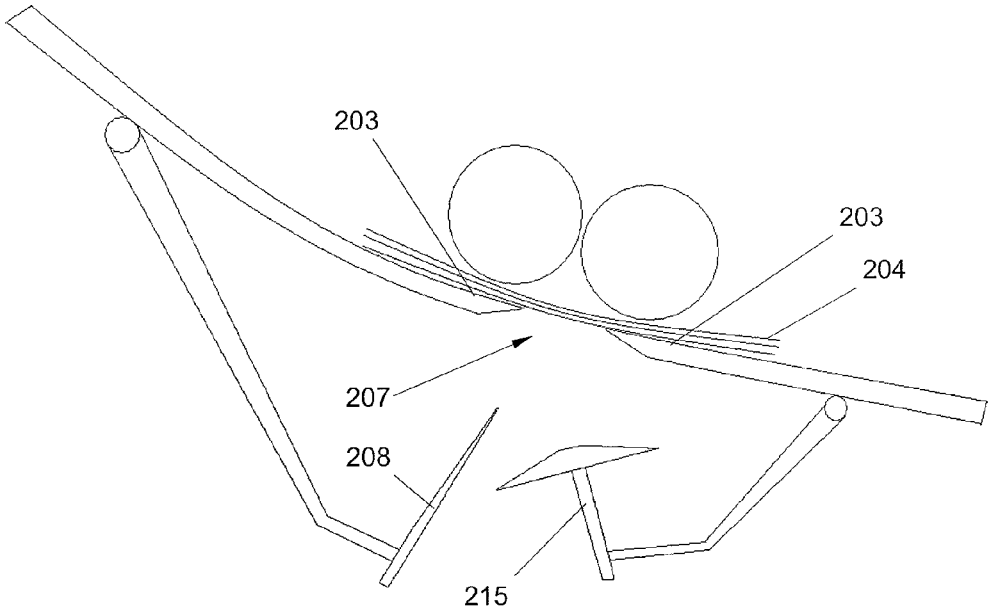
FIG. 6 is a schematic side view of a third example of an apparatus according to the invention.

In yet another embodiment according to the invention, shown in FIG. 6, the folding blade 208 and pressing member 215 are provided with retracted positions, such that either the folding blade 208 can move freely from the retracted position towards the folding position or that the pressing member 215 can move freely from the retracted position to the operating position.

In this example, the interruption 207 of the support surface extends across a portion of the width of the support surface 203 only, to prevent the stack 204 from sagging into the opening 207.

Figure 7:
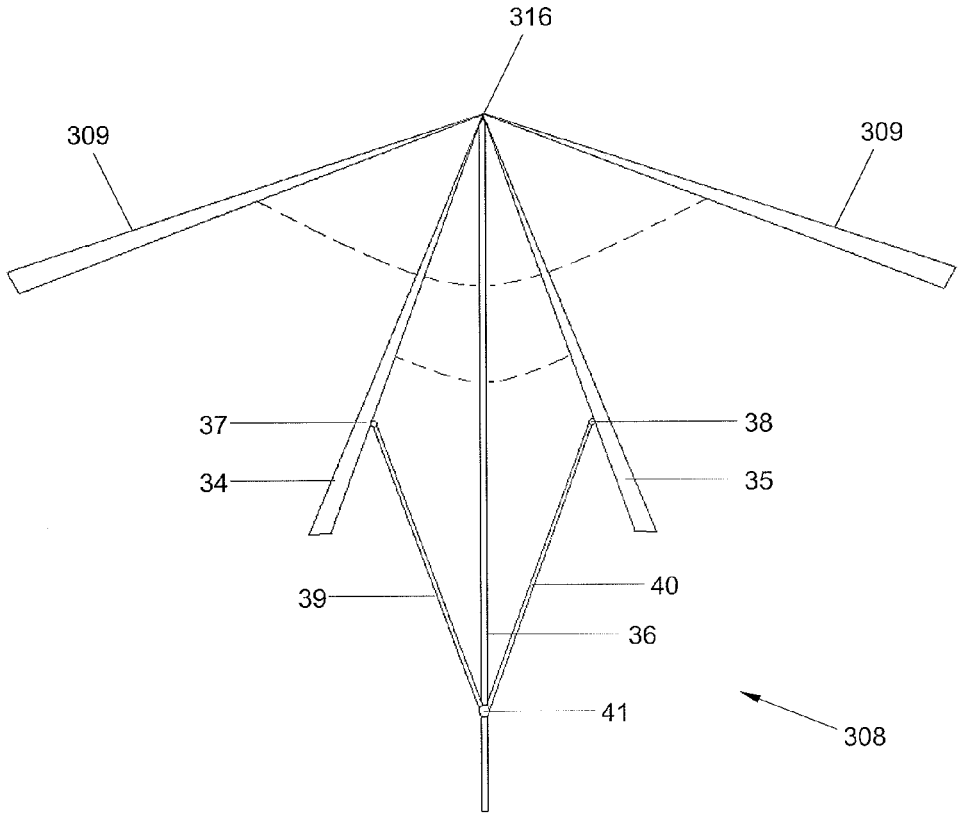
FIG. 7 is a schematic side view of a pressing member and folding blade of a fourth example of an apparatus according to the invention.

In FIG. 7 another embodiment of a folding blade according to the invention is shown. The folding blade 308 is provided with pressing plates 34, 35 on opposite sides converging in a free edge 316 located at an end of axis 36. Furthermore, the pressing plates are connected to axis 36 with hinges 37, 38 and arms 39, 40. The arms 39, 40 are attached to slide 41, which is slidably mounted on axis 36. The angle between the pressing plates 34, 35 depends on the position of the slide 41. At a first angle the pressing plates 34, 35 are close together in a folding position. At a second larger angle the pressing plates 34, 35 are spread apart in a pressing position. By movement of the slide 41 along axis 36 each of the pressing plates 34, 35 is pivoted, wherein the free edge 316 forms a pivot point. Moving the slide 41 towards the free edge 316 along the axis 36 pivots the pressing plates 34, 35 apart, while moving the slide 41 away from the free edge 316 pivots the pressing plates 34, 35 towards each other.

By providing the folding blade 308 with pressing plates 34, 35 reciprocally pivotable between a folding position close together and a pressing position pivoted apart, the outer surface areas of the pressing plates 34, 35 in the pivoted apart positions constitute pressing surface areas 309. Thus, it can either function as a folding blade for folding a stack of sheets as one single set, or it can function as a pressing member for pressing a stack of sheets against a pair of folding rollers for selectively separating and folding an outer sheet of the stack.

In this manner, an apparatus provided with a folding blade 308 with pressing plates 34, 35 on opposite sides as shown in FIG. 7 can simply switch between these modes of operation by adjusting the angle of the pressing plates 34, 35. Thus, either pivoting the plates 34, 35 to a folding position close together when moving the blade 308 into the folding position; or pivoting the plates 34, 35 apart to a pressing position when moving the outer surface areas of the pressing plates 34, 35 constituting the pressing surface areas 42, 43 into the pressing position.

While the invention has been illustrated and described in detail in the drawings and foregoing description, such illustration and description are to be considered illustrative or exemplary and not restrictive; the invention is not limited to the disclosed embodiments. For example a pressing member, shaped as a triangle having two sides converging in a blunt angle constituting pressing surfaces and another angle constituting a free edge, may be rotatable between a folding position wherein the free edge faces a pair of folding rollers and a pressing position wherein the pressing surfaces face the pair of folding rollers.

Other variations to the disclosed embodiments can be understood and effected by those skilled in the art in practicing the claimed invention, from a study of the drawings, the disclosure, and the appended claims.

The invention claimed is:

1. An apparatus for feeding sheets from a sheet support and for folding the sheets fed from the feed support, comprising:

a pair of folding rollers defining a folding nip;

a sheet support for supporting a stack of sheets the sheet support having a support surface facing the nip;

a folding blade having a free edge, the folding blade being reciprocably movable relative to the folding rollers between a retracted position in which the free edge is spaced from the nip and a folding position in which the free edge is oriented towards the nip and closer to the nip than in the retracted position, for pressing a plied portion of the sheets between the free edge and the nip into the nip, blade surfaces adjacent to the free edge, at least when the blade is in the folding position, converging towards the free edge at a first angle;

a pressing mechanism having pressing surface areas facing said folding rollers, the pressing surface areas being reciprocably movable relative to the folding rollers between a retracted position spaced from the folding rollers and a pressing position in which the pressing surface areas are closer to the folding rollers than in the retracted position, face the folding rollers, and enclose a second angle larger than said first angle, at least when in the pressing position, for pressing the stack of sheets against the folding rollers; and a drive for selectively moving either said folding blade into said folding position or said pressing surface areas into said pressing position.

2. An apparatus according to claim 1, wherein the pressing mechanism includes a pressing member of which outer surface portions constitute the pressing surface areas, the pressing member being reciprocably movable between a rest position in which the pressing surface areas are in the retracted position and an operating position in which the pressing surface areas are in the pressing position; and wherein the drive is arranged for effecting movement of the pressing surface areas into said pressing position by moving the pressing member into the operating position.

3. An apparatus according to claim 2, wherein the folding blade in the folding position projects through a passage between the pressing surface areas.

4. An apparatus according to claim 1, wherein the pressing surface areas are surface areas of the sheet support.

5. An apparatus according to claim 1, wherein the folding blade has pressing plates on opposite sides, the plates being reciprocably pivotable between a folding position close together and a pressing position pivoted apart, outer surface areas of the pressing plates in the pivoted apart positions constituting the pressing surface areas.

6. A method for selectively either folding only an outer sheet from a stack of sheets in a sheet support or simultaneously folding all sheets in a stack on a sheet support, the method comprising:

providing a pair of folding rollers defining a folding nip in a position such that a sheet support surface of the sheet support faces the nip;

providing a folding blade having a free edge spaced from the nip, blade surfaces adjacent to the free edge, at least when the blade is in the folding position, converging towards the free edge at a first angle;

providing a pressing mechanism having pressing surface areas spaced from the folding rollers; and rotating the folding rollers in a sense of transport;

either moving the folding blade towards the nip into a folding position, thereby pressing a plied portion of the stack of sheets between the free edge and the nip into the nip and causing the stack of sheets to be folded and entrained by the rotating folding rollers; or at least moving the pressing surface areas towards the folding rollers into a pressing position, wherein, at least in the pressing position, the pressing surface areas enclose a second angle larger than said first angle, thereby pressing the stack of sheets against the folding rollers, such that only an outer sheet of the stack is engaged, plied into the folding nip, folded and entrained through the nip by the rotating folding rollers.

7. A method according to claim 6, further comprising:

providing the pressing mechanism with a pressing member of which outer surface portions constitute the pressing surface areas, moving the pressing surface areas in the pressing position by moving the pressing member from a rest position to an operating position; and effecting movement of the pressing surface areas into said pressing position by moving the pressing member into the operating position with a drive.

8. A method according to claim 6, further comprising providing the folding blade with pressing plates on opposite sides;

pivoting the pressing plates to a folding position close together when moving the blade into the folding position; and pivoting the pressing plates apart to a pressing position when moving the outer surface areas of the pressing plates constituting the pressing surface areas into the pressing position.

* * * * *